US006249924B1

(12) United States Patent
Kluft

(10) Patent No.: US 6,249,924 B1
(45) **Date of Patent: *Jun. 26, 2001**

(54) ANTI-ROLL OFF MATTRESS CONSTRUCTION

(76) Inventor: Earl Sanderson Kluft, 3924 Ethel Ave., Studio City, CA (US) 91604

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/801,830

(22) Filed: Feb. 14, 1997

(51) Int. Cl.[7] ..... A47C 23/04
(52) U.S. Cl. ..... 5/716; 5/717; 5/729; 5/739
(58) Field of Search ..... 5/716, 717, 718, 5/729, 739, 740, 655.6, 408, 727

(56) References Cited

U.S. PATENT DOCUMENTS

| | | | | |
|---|---|---|---|---|
| 1,432,875 | | 10/1922 | Lavagetto . | |
| 1,873,607 | * | 8/1932 | Lefevre | 5/655.6 |
| 2,154,910 | | 4/1939 | Magaril . | |
| 3,148,387 | | 9/1964 | Sarnie, Jr. et al. . | |
| 3,822,426 | | 7/1974 | Mistarz . | |
| 3,846,857 | * | 11/1974 | Weinstock | 5/727 |
| 3,848,283 | | 11/1974 | Ikeda . | |
| 3,855,653 | * | 12/1974 | Stalter | 5/351 |
| 4,286,344 | * | 9/1981 | Ikeda | 5/716 |
| 4,607,402 | * | 8/1986 | Pollard | 5/425 |
| 4,872,228 | * | 10/1989 | Bishop | 5/425 |
| 4,975,996 | | 12/1990 | Evans et al. . | |
| 4,980,940 | | 1/1991 | Isshiki . | |
| 5,210,890 | * | 5/1993 | Hagglund | 5/718 |
| 5,222,264 | * | 6/1993 | Morry | 5/718 |
| 5,239,715 | * | 8/1993 | Wagner | 5/475 |
| 5,513,401 | * | 5/1996 | Abe et al. | 5/716 |
| 5,537,699 | * | 7/1996 | Bonaddio et al. | 5/474 |

* cited by examiner

*Primary Examiner*—Michael F. Trettel
*Assistant Examiner*—Fredrick Conley

(57) ABSTRACT

A mattress having an anti-roll off feature is disclosed. The mattress has an innerspring unit having an array of coiled compression springs separating opposed parallel surfaces, wherein the surfaces are covered by a webbing made of a nonwoven polypropylene, and wherein the outer periphery of the webbing has horizontally disposed rigid foam planks wrapped and held in place by the webbing. The foam planks are formed from polyethylene foam. Additionally, vertically disposed rigid polyethylene foam planks with cross members are situated within the innerspring unit between the compressions springs at the periphery of the innerspring unit. The foam planks with cross members provide the support needed to achieve the anti-roll off feature. In an alternative embodiment, rigid polyethylene foam cylinders are placed within the rows of compression springs at the periphery of the innerspring unit to provide support at those locations.

20 Claims, 3 Drawing Sheets

ANTI-ROLL OFF MATTRESS CONSTRUCTION

BACKGROUND OF THE INVENTION

1. Field of the Invention

The present invention relates generally to mattress construction. More precisely, the present invention relates to a mattress having an anti-roll off feature.

2. Description of the Prior Art and Related Information

In conventional mattresses for use as beds, it is important to have a more firm or rigid perimeter surrounding a less firm body. Due to wear and tear, typically, the edge of a conventional mattress might sag, shift, lose its form, etc. A sleeper lying on the mattress might inadvertently roll off the mattress due to the lack of support at the sagging edge. To overcome this problem, there have been many approaches to designing a mattress with an anti-roll off feature.

Most improvements focus on the innerspring unit of the mattress. The innerspring unit is usually made from a plurality of spring coils arranged side-by-side in a rectangular matrix. A border made of metal wires encircling both the upper and lower surfaces frame the innerspring. The plurality of helical spring coils are positioned in a spaced apart relationship within the innerspring unit to provide the internal support for the mattress.

Some examples of anti-roll off mattresses using a modified innerspring unit are disclosed in the following. U.S. Pat. No. 4,286,344 to Ikeda discloses an anti-roll off mattress that includes a pair of ridges formed on a sheet of elastomeric material that covers both sides of an innerspring unit. The elastomeric material is attached to the innersprings. U.S. Pat. No. 5,239,715 to Wagner discloses a border stabilizing and reinforcing member for use in mattresses. Specifically, a plurality of rhomboid-shaped members of resilient material are placed in the innerspring unit of a mattress between adjacent rows of springs. When placed as a beam between the springs, the rhomboid-shaped members improve firmness of the mattress.

U.S. Pat. No. 5,537,699 to Bonaddio et al. discloses a mattress border construction including a foam rail sleeve encasing a single row of coiled springs so that the top, bottom, and sides of the row of springs are surrounded by foam. Essentially, the coiled springs encased in the foam sleeve reinforce the border or edges of the innerspring unit giving it strength.

Another method of preventing roll-off is a mattress topper pad consisting of sheets of foam padding wherein the soft foam is located in the middle of the sheet and the hard foam is located at the periphery or edges. Two or three of these sheets are laid on top of the innerspring unit in order to achieve the anti-roll off effect.

Other conventional methods of creating an anti-roll off mattress include a bed guard comprising at least one elongated bolster assembled on top of a conventional mattress held in a position along one edge of the bed. A plurality of bolsters may be used on each edge of the bed for additional roll-off protection. Another design suggests using an array of pockets in which cylindrically shaped foam members are inserted to define a retainer structure enclosing a sleeping area on the mattress. Another conventional mattress design suggests using elastic foamed block inserts positioned into the void spaces left in the innerspring assembly at the periphery of the mattress. Still another prior art design mattress teaches a mattress topper pad and border stabilizer means for mattress innerspring units. The topper pad portion overlies the top or bottom of the coil innerspring unit while the border stabilizer portion is inserted between at least one convolution of each coil on the outside row of the coil innerspring unit to stiffen the spring action of the coils.

Another conventional mattress is constructed with a sleep surface or an overlying sheet on the mattress to produce a raised portion thereof. In another mattress design, the mattress has an upper surface that tapers from the head end toward the foot end. The mattress has an upwardly extending rolled rim on both sides of the mattress to increase the comfort for the sleeper and to prevent the sleeper from accidentally rolling off the bed. Examples of the foregoing mattress construction technology are discussed in, for example, U.S. Pat. No. 4,872,228 to Bishop; U.S. Pat. No. 4,607,402 to Pollard; U.S. Pat. No. 3,848,283 to Ikeda; U.S. Pat. No. 3,822,426 to Mistarz; U.S. Pat. No. 3,148,387 to Sarnie; and U.S. Pat. No. 1,432,875 to Lavagetto. There is, however, still a need for an improved anti-roll off mattress that is durable, and is economical and easy to manufacture.

SUMMARY OF THE INVENTION

In view of the foregoing, it is an object of the present invention to provide a mattress having an anti-roll off feature. It is another object of the present invention to provide a mattress that is economical and easy to manufacture. It is yet another object of the present invention to provide a mattress employing rigid foam planks, blocks, or inserts placed within the innerspring unit to reinforce the outer perimeter of the mattress. It is yet another object of the present invention mattress to incorporate use of rigid foam blocks or planks wrapped in a sheet of pliable material stretched across the mattress as in webbing.

In order to achieve the foregoing objects, the present invention is directed to a mattress having an anti-roll off feature comprising an innerspring unit having a plurality of compression springs separating opposed first and second surfaces, each surface having an exterior facing away from the springs and an interior engaging the springs, and each surface having an outer perimeter circumscribing the surface. The invention further includes at least one rigid foam block or plank vertically disposed inside the innerspring unit between the interiors of the first and second surfaces at the outer perimeter; at least two blocks or planks of rigid foam horizontally disposed on the exterior of the first surface at opposed perimeters thereof; at least one pliable sheet spread over the exterior of the first surface, wherein the pliable sheet is wrapped around the horizontal rigid foam blocks disposed at the outer perimeter; and padding disposed over the exterior of the first surface in between the horizontal foam blocks.

In an alternative embodiment, the rigid foam blocks vertically disposed inside the innerspring unit can be replaced with rigid foam cylinders that can be individually dropped into the open space within each helical compression spring. Accordingly, one or more rows of the compression springs situated at the outer perimeter of the innerspring unit can contain a rigid foam cylinder to enhance the resilience and rigidity at the outside edges of the innerspring unit.

In a preferred embodiment, the rigid foam blocks or planks are formed from a polyethylene foam material. The polyethylene foam material is known in the industry as ETHAFOAM 220. The pliable sheets used to wrap the planks or blocks and to create the webbing spread across the mattress are preferably made from a nonwoven, polypropylene material.

Accordingly, the present invention innerspring unit has reinforced edges that prevent roll-off and enhance the durability of the mattress edges. Indeed, the rigid foam planks incorporated into the innerspring unit help retain the shape of the mattress and give the sleeper firm support at the edges of the mattress.

The present invention innerspring unit is easy to manufacture in a high production environment because the constituent parts are assembled in layers. For example, in the embodiment using rigid foam cylinders, each cylinder is dropped into the open centers of the compression springs situated around the perimeter of the innerspring unit. Assembling the horizontally disposed rigid foam blocks wrapped in the pliable sheet is simply a matter of laying the pliable sheet material across the innerspring unit at one stage of assembly. By wrapping the horizontal blocks, there is the added advantage of securing the horizontal blocks in place, thereby preventing the foam blocks from shifting or moving out of position relative to the innerspring unit. Therefore, the present invention is well suited for high production and does not increase production costs noticeably.

BRIEF DESCRIPTION OF THE DRAWINGS

The objects, features, and advantages of the present invention will be apparent to one skilled in the art from reading the following detailed description in which.

DETAILED DESCRIPTION OF THE PREFERRED EMBODIMENTS

Figure 1:
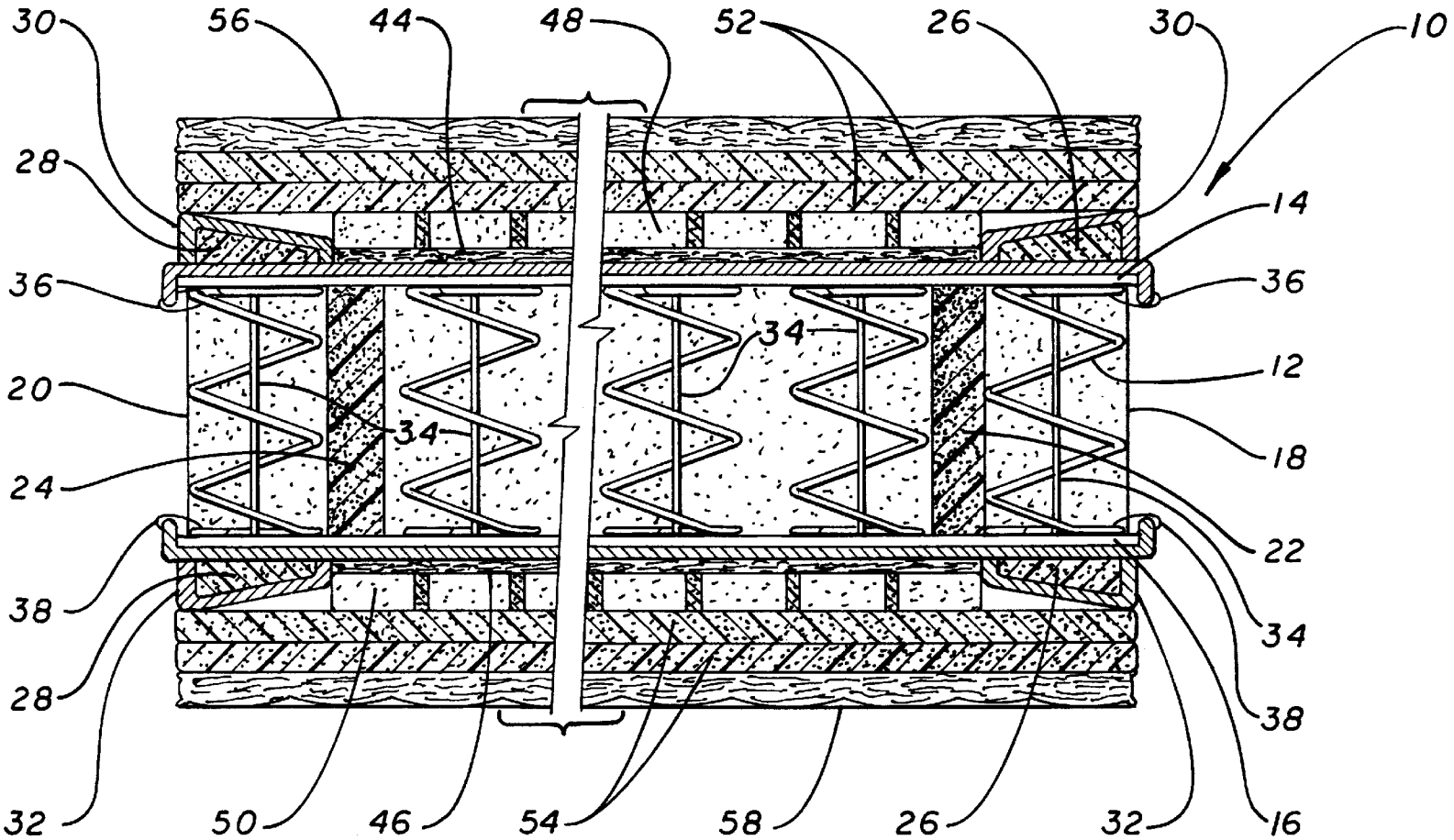
FIG. 1 is a cross-sectional elevational view showing the internal construction of a preferred embodiment innerspring unit in accordance with the present invention.

FIG. 1 provides a side elevational view of a preferred embodiment of the present invention. Specifically, FIG. 1 shows a cross-sectional view of an innerspring unit 10 having an anti-roll off feature. The innerspring unit 10 is preferably constructed from an array of coiled compression springs 12 evenly spaced apart and separating two surfaces defined by top and bottom wire frames 14, 16. Wire frames 14, 16 are made of heavy gauge wire, and have a generally rectangular shape corresponding to the size and shape of the innerspring unit 10. Each one of the compression springs 12 is attached to the wire frames 14, 16.

At the outer periphery of the wire frames 14, 16 corresponding to the outer periphery of the innerspring unit 10, the present invention includes vertically disposed rigid foam planks or blocks 18, 20. The vertically disposed rigid foam blocks 18, 20 preferably are situated at the outer periphery of the innerspring unit 10 in order to improve rebound, resilience, and durability of the outer periphery of the innerspring unit 10.

In the preferred embodiment, the vertically disposed rigid foam blocks 18, 20 are formed from long planks of polyethylene foam having a rectangular cross-section. Other cross-sectional shapes such as a circle or triangle are contemplated. The polyethylene foam material is known in the art as ETHAFOAM 220, and is currently supplied by the Dow Chemical Company. Styrofoam, stiff polyurethanes, and the like may be used for the blocks, too.

In the preferred embodiment, the rigid foam blocks 18, 20 extend along the length and width of the innerspring unit 10. Each block 18, 20 has optional cross members 22, 24 made of the same material in order to bring more stiffness and support to the innerspring unit 10. The cross members 22, 24 have a rectangular cross-section and preferably engage and intersect the blocks 18, 20 at a right angle.

In FIG. 1, the rigid foam blocks 18, 20 on the left and right side are shown along with their respective cross-members 22, 24. On the other hand, the rigid foam blocks situated at the head end and foot end of the innerspring unit 10 have been omitted in order to expose the interior construction.

As seen in FIG. 1, the present invention innerspring unit 10 further includes horizontally disposed rigid foam planks or blocks 26, 28. Preferably, the horizontally disposed rigid foam blocks 26, 28 have a slight wedge or cuneiform in their cross-sectional shape. The sloped surface provides a greater sleeping area in the middle of the mattress as well as providing a slight cavity to lay down panels of upholstery in subsequent assembly steps.

These horizontally disposed foam blocks 26, 28 are also preferably made entirely from planks of ETHAFOAM 220. In an alternative embodiment, and as seen in FIG. 1*a*, each horizontally disposed rigid foam block 26, 28 may further have two densities with a softer portion 27 at the sloped area and a firmer section 29 just beneath. In another variation, the wedge shaped block is made from two distinct materials, wherein the wedge or sloped portion of the block is made from a softer polyurethane, while the rectangular block portion beneath is made from rigid ETHAFOAM 220. With this type of construction, the sleeper only feels the softer material on top while the firmer structure beneath provides adequate support to prevent roll off.

Each horizontally disposed rigid foam block 26, 28 extends preferably the length and width of the innerspring unit 10. Furthermore, each section of the horizontally disposed rigid foam block 26, 28 is wrapped in a pliable sheet 30, 32 that is stretched across the innerspring unit 10 forming a webbing. Button tufting 34 is used to anchor the pliable sheets 30, 32 to the innerspring unit 10. Moreover, the outside edges of the pliable sheets 30, 32 are anchored by wire loops 36, 38, or hog rings, to the outer rows of compression springs 12. With the button tufting and anchoring wire loops 36, 38, the pliable sheets 30, 32 are securely fastened to the wire frames 14, 16, and in turn the pliable sheets 30, 32 securely anchor the horizontally disposed foam blocks 26, 28 to the outer perimeter of innerspring unit 10. It is therefore unlikely that the horizontally disposed rigid foam blocks 26, 28 can shift in use during the life of the innerspring unit 10.

In the preferred embodiment, the pliable sheets 30, 32 are made from nonwoven polypropylene. This material is known in the industry under the trade name AMOLENE, and is supplied by Amoco Fabrics and Fiber Company. Other fibrous materials known in the art, such as felt, can be used.

Figure 2:
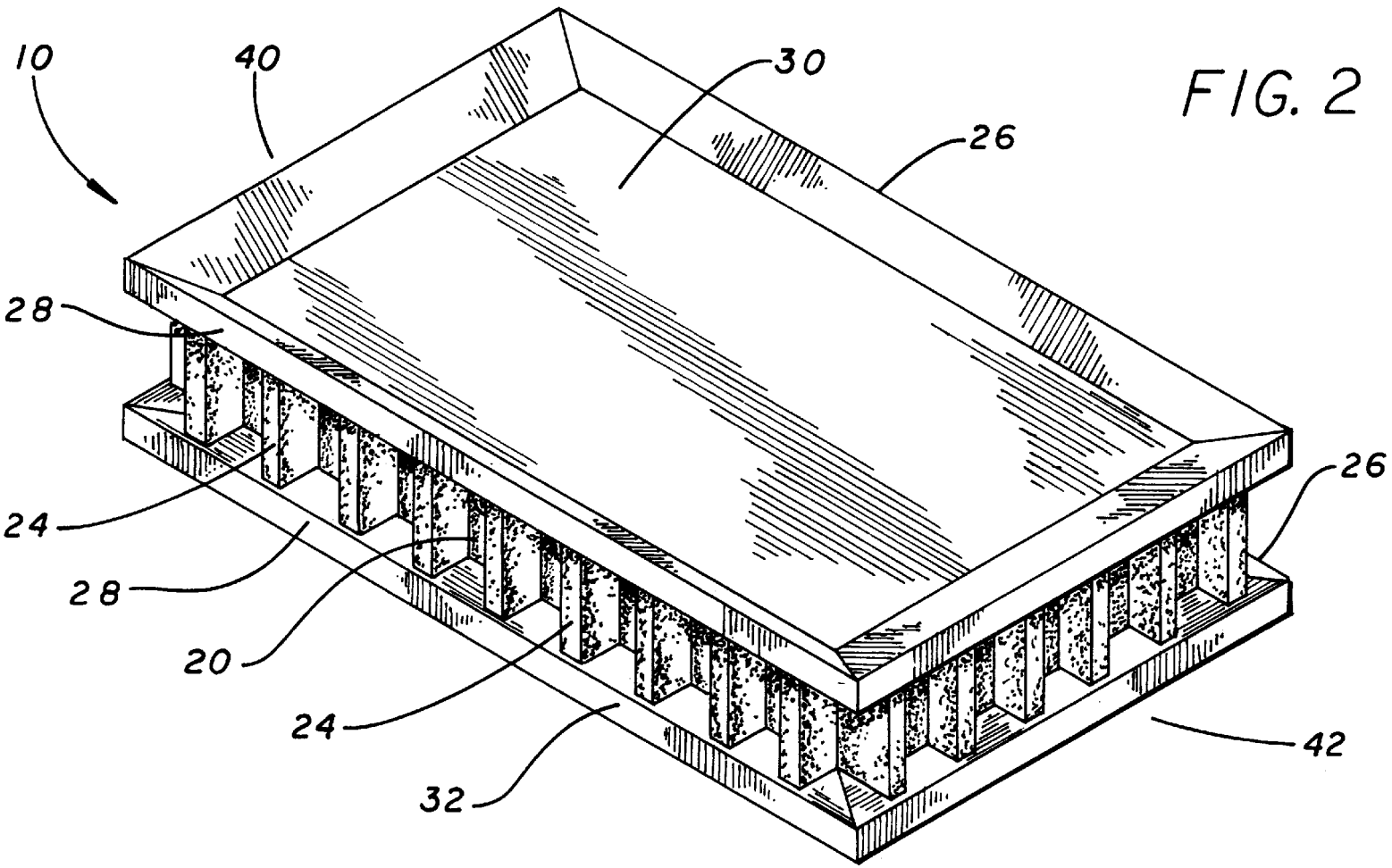
FIG. 2 is a perspective view showing the anti-roll off structure including the vertically disposed rigid foam planks integrated into the innerspring unit and the horizontally disposed rigid foam planks wrapped in a pliable sheet disposed on the outside of the innerspring unit.

FIG. 2 provides a perspective view of the present invention innerspring unit 10 with anti-roll off structures. FIG. 2 shows the wedge shaped horizontally disposed rigid foam planks or blocks 26, 28 wrapped in pliable sheets 30, 32 and spread across the innerspring unit 10. FIG. 2 further shows the vertically disposed rigid foam planks or blocks 18, 20 and their respective cross members 22, 24 positioned within innerspring unit 10. FIG. 2 further illustrates the anti-roll off structures positioned at the head end 40 and foot end 42 of innerspring unit 10. These structures were omitted from FIG. 1 for ease of explanation and illustration.

Returning to FIG. 1, the drawing depicts upholstery that is added to innerspring unit 10 to complete the mattress construction. In particular, inbetween the pliable sheets 30, 32 and the wire frame 14, 16 is an optional layer of polypropylene mesh (not shown). The next layer adjacent to pliable sheets 30, 32 is a layer of cotton batt 44, 46. Immediately next to cotton batt 44, 46 is a topper pad 48, 50 made preferably of a latex material. There can be another layer of nonwoven fabric covering topper pad 48, 50. The tufting 34 extends through the previous layers and are buttoned down in a process known in the art.

Directly adjacent to the topper pads 48, 50 are optional layers of full recovery foam, otherwise known as viscoelastic foam 52, 54. Immediately adjacent to the layers of viscoelastic foam 52, 54 are optional panels consisting of ticking 56, 58, which is a quilted combination of natural fibers, polyester, and polyurethane foam.

Of course, the selection and arrangement of the aforementioned upholstery layers can be modified to adjust for the firmness and resiliency of the mattress as needed. For example, cotton batt 44, 46 can be replaced by natural cashmere batting, and layers of convoluted high density foam can be added or substituted for the viscoelastic foam 52, 54.

Figure 3:
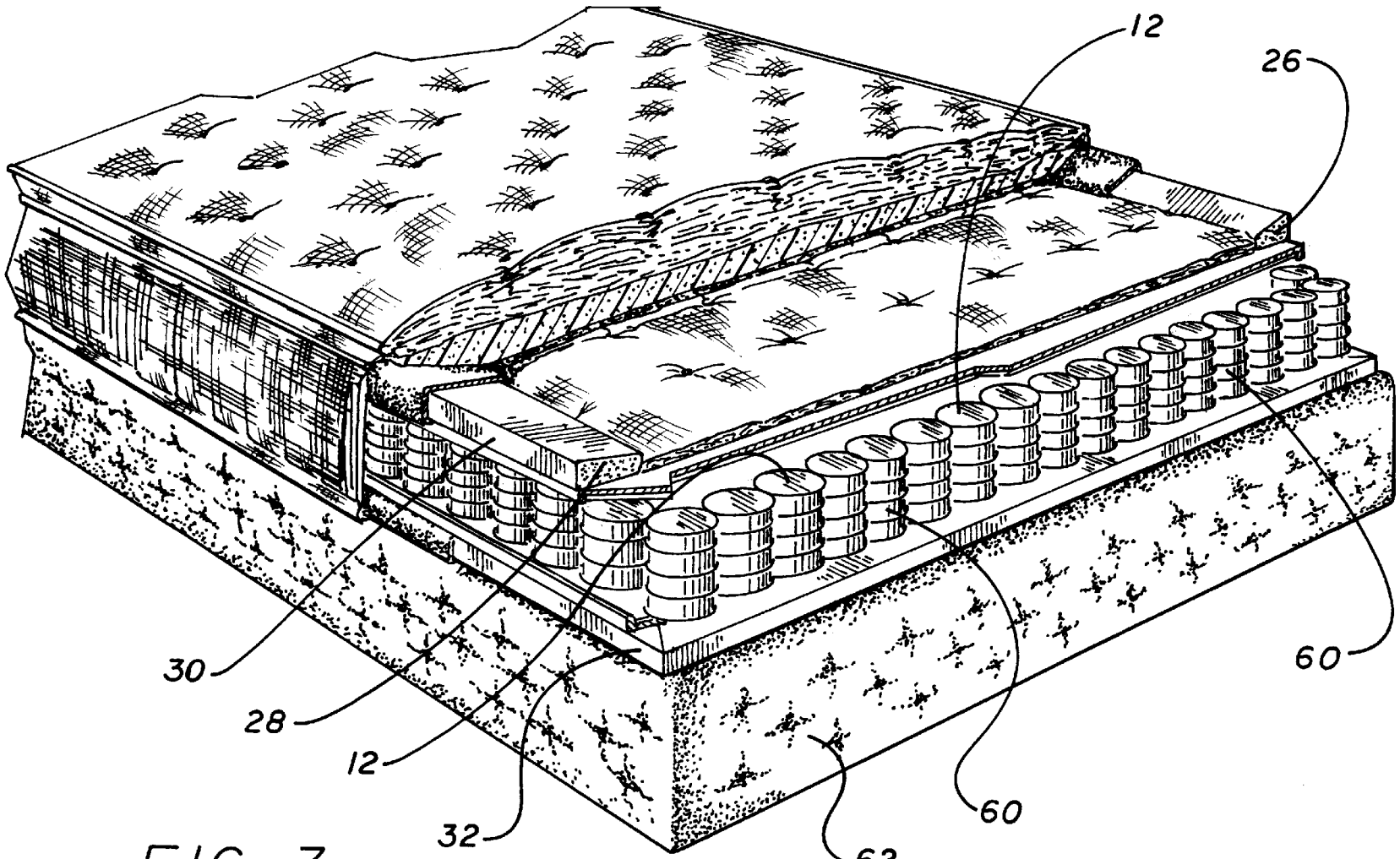
FIG. 3 is a perspective view showing the interior contents of an alternative embodiment innerspring unit using rigid foam cylinders placed inside one or more rows of compression springs disposed along the outer perimeter of the innerspring unit.

FIG. 3 is a perspective view of an alternative embodiment showing a construction similar to FIG. 1, except that the vertically disposed rigid foam blocks 18, 20 and cross-members 22, 24 have been replaced by rigid foam cylinders 60. The rigid foam cylinders are preferably made from ETHAFOAM 220 or stiff Styrofoam. In FIG. 3, the present invention innerspring unit 10 is shown positioned on top of a conventional box spring 62. The construction of innerspring unit 10 is like that shown in FIG. 1, wherein a plurality of compression springs 12 are arranged in a matrix to separate opposed parallel surfaces that are covered with pliable sheets 30, 32, which at the edge or periphery have horizontally disposed rigid foam blocks 26, 28 wrapped therein.

As seen in FIG. 3, in the preferred embodiment, rigid foam cylinders 60 are placed within the open centers of each coiled compression spring 12 located along the outer periphery of innerspring unit 10 to reinforce the firmness at the edge of innerspring unit 10. There can be one or more rows of compression springs 12 loaded with rigid foam cylinders 60. The upholstery material added to innerspring unit 10 are similar to that described in connection with FIG. 1.

What is claimed is:

1. A mattress having an anti-roll off feature comprising:

an innerspring unit having a plurality of compression springs separating opposed first and second surfaces, each surface having an exterior facing away from the springs and an interior engaging the springs, and each surface having an outer perimeter circumscribing the surface;

at least one substantially rigid foam block vertically disposed inside the innerspring unit between the interiors of the first and second surfaces at the outer perimeter;

at least two blocks of substantially rigid foam horizontally disposed on the exterior of the first surface at opposed perimeters thereof;

at least one pliable sheet spread edge-to-edge over the exterior of the first surface, wherein said at least one pliable sheet is wrapped around the horizontal rigid foam blocks disposed at the outer perimeter; and padding anchored to the innerspring unit and disposed over the pliable sheet and in between the horizontal foam blocks providing an even sleeping surface above the horizontal foam blocks and said at least one pliable sheet.

2. The mattress according to claim 1, wherein the mattress further comprises:

at least two blocks of rigid foam horizontally disposed on the exterior of the second surface at opposed perimeters thereof;

at least one pliable sheet spread over the exterior of the second surface, wherein the pliable sheet is wrapped around the horizontal rigid foam blocks disposed at the outer perimeter of the second surface; and an upholstery panel disposed over the exterior of the second surface in between the horizontal foam blocks.

3. The mattress according to claim 1, wherein the mattress further comprises vertically disposed rigid blocks positioned at the perimeter.

4. The mattress according to claim 1, wherein the rigid foam blocks include polyethylene foam.

5. The mattress according to claim 1, wherein the rigid foam blocks include a polyurethane material.

6. The mattress according to claim 1, wherein the pliable sheet includes nonwoven polypropylene.

7. The mattress according to claim 1, wherein the rigid foam blocks have a rectangular cross-sectional shape.

8. The mattress according to claim 1, wherein mattress further comprises tufting positioned between the interiors of the first and second surfaces, and interconnecting the first and second surfaces.

9. The mattress according to claim 1, wherein the padding includes a latex material.

10. The mattress according to claim 1, wherein a part of the pliable sheet is anchored to one spring.

11. The mattress according to claim 1, wherein the vertically disposed block further comprises cross member blocks.

12. A mattress having an anti-roll off feature comprising:

an innerspring having a rectangular wire frame and a plurality of compression springs disposed in parallel between an interior formed by first and second planar surfaces, each planar surface having opposed perimeters and opposed exteriors;

blocks of substantially rigid foam disposed vertically in between the first and second planar surfaces;

at least one block of substantially rigid foam disposed horizontally overlying the corresponding first and second planar surfaces at said opposed perimeters;

a first pliable sheet wrapping the horizontally disposed block and disposed edge-to-edge over the exterior of the first planar surface;

a second pliable sheet wrapping the horizontally disposed block and disposed edge-to-edge over the exterior of the second planar surface;

a first upholstery panel attached to the first pliable sheet and disposed over the first pliable sheet and also disposed over the horizontally disposed block wrapped in the first pliable sheet to thereby form a first generally planar sleeping surface extending across the width of the entire mattress; and a second upholstery panel attached to the second pliable sheet and disposed over the second pliable sheet and also disposed over the horizontally disposed block wrapped in the second pliable sheet to thereby form a second generally planar sleeping surface extending across the width of the entire mattress.

13. The mattress of claim 12, wherein each compression spring includes a coiled spring having an open center and wherein each block of rigid foam disposed vertically is positioned in the open centers of the coiled springs located at the perimeter of the first and second planar surfaces.

14. The mattress of claim 12, wherein the blocks of rigid foam disposed vertically has a cylindrical shape.

15. The mattress of claim 12, wherein the blocks of rigid foam disposed vertically includes polyethylene foam.

16. The mattress of claim 12, wherein the horizontally disposed blocks circumscribe the first surface and second surface at the respective perimeters.

17. The mattress of claim 12, wherein the block of rigid foam disposed horizontally has a wedge shape.

18. The mattress of claim 12, wherein the block of rigid foam disposed horizontally has a wedge shape and wherein the block has a firm portion and a soft portion.

19. The mattress of claim 12, wherein the block of rigid foam disposed horizontally has a wedge shape cross-section including a sloped portion and a rectangular portion, and wherein the sloped portion includes soft polyurethane and the rectangular portion includes polyethylene foam.

20. A method for constructing a mattress having an anti-roll off feature comprising the steps of:

providing an innerspring having a rectangular wire frame and a plurality of compression springs disposed in parallel between an interior formed by first and second planar surfaces, each planar surface having opposed perimeters and opposed exteriors;

positioning blocks of substantially rigid foam disposed vertically inside the compression springs located at said opposed perimeters;

providing at least one block of substantially rigid foam disposed horizontally overlying the corresponding first and second planar surfaces at said opposed perimeters;

wrapping a first pliable sheet around the horizontally disposed block and disposing the first pliable sheet edge-to-edge over the exterior of the first planar surface;

wrapping a second pliable sheet around said at least one block and disposing the second pliable sheet over the exterior of the second planar surface; and providing at least one upholstery layer stably disposed over each of the first and second pliable sheets and over the horizontally disposed foam blocks such that parallel opposed generally planar sleeping surfaces are formed extending between the opposed perimeters.

* * * * *